US008708328B2

(12) United States Patent
Kannari et al.

(10) Patent No.: US 8,708,328 B2
(45) Date of Patent: Apr. 29, 2014

(54) SHEET FEEDING APPARATUS AND IMAGE FORMING SYSTEM

(71) Applicant: Canon Kabushiki Kaisha, Tokyo (JP)

(72) Inventors: Isao Kannari, Kashiwa (JP); Taro Ikeda, Tokyo (JP); Takashi Uno, Kashiwa (JP); Yuji Yamanaka, Toride (JP); Yuya Yokobori, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/674,798

(22) Filed: Nov. 12, 2012

(65) Prior Publication Data

US 2013/0134651 A1 May 30, 2013

Related U.S. Application Data

(62) Division of application No. 12/695,955, filed on Jan. 28, 2010, now Pat. No. 8,328,181.

(30) Foreign Application Priority Data

Jan. 29, 2009 (JP) ..... 2009-018275

(51) Int. Cl.
*B65H 3/12* (2006.01)

(52) U.S. Cl.
USPC ..... 271/94; 271/97; 271/98

(58) Field of Classification Search
USPC ..... 271/90, 94, 97, 98
See application file for complete search history.

(56) References Cited

U.S. PATENT DOCUMENTS

| | | | | |
|---|---|---|---|---|
| 5,876,030 | A * | 3/1999 | Dobbertin et al. | 271/13 |
| 5,988,629 | A * | 11/1999 | Burlew et al. | 271/152 |
| 6,082,728 | A * | 7/2000 | Ubayashi | 271/108 |
| 7,364,150 | B2 * | 4/2008 | Nakane | 271/97 |
| 7,380,781 | B2 * | 6/2008 | Ikeda | 271/98 |
| 7,461,839 | B2 * | 12/2008 | Ikeda | 271/108 |
| 7,575,231 | B2 * | 8/2009 | Sasaki et al. | 271/98 |
| 7,753,358 | B2 * | 7/2010 | Ikeda | 271/104 |
| 2008/0315498 | A1 * | 12/2008 | Ikeda | 271/18 |
| 2010/0090392 | A1 * | 4/2010 | Ikeda | 271/109 |

* cited by examiner

*Primary Examiner* — Kaitlin Joerger
(74) *Attorney, Agent, or Firm* — Canon USA Inc. IP Division

(57) ABSTRACT

A sheet feeding apparatus includes a sheet stacking unit, a suction conveyance unit configured to convey an uppermost sheet stacked on the sheet stacking unit, a suction unit configured to adsorb the sheets onto the suction conveyance unit, and an adsorption completion detection unit. In the sheet feeding apparatus, when the tab-attached sheets are stacked on the sheet stacking unit and fed such that their tab portions are on the downstream side in a sheet feeding direction, the suction unit starts to adsorb the sheet and the suction conveyance unit starts to convey the sheet immediately after the adsorption completion detection unit detects the completion of the adsorption. When the sheets other than the tab-attached sheets are fed, the suction unit previously adsorbs the sheet onto the suction conveyance unit, and the suction conveyance unit starts to convey the sheet in response to the sheet feeding signal.

8 Claims, 11 Drawing Sheets

SHEET FEEDING APPARATUS AND IMAGE FORMING SYSTEM

CROSS-REFERENCE TO RELATED APPLICATIONS

This application is a divisional of application Ser. No. 12/695,955 filed Jan. 28, 2010 that claims the benefit of Japanese Patent Application No. 2009-018275 filed Jan. 29, 2009, both of which are hereby incorporated by reference in their entirety.

BACKGROUND OF THE INVENTION

1. Field of the Invention

The present invention relates to a sheet feeding apparatus that feeds stacked sheets one at a time and an image forming system including the sheet feeding apparatus.

2. Description of the Related Art

Conventionally, some image forming systems have been configured by connecting a sheet feeding unit, an insertion apparatus, a post-processing apparatus, and so on to an image forming apparatus such as a printer or a copying machine. The body of the image forming apparatus, the sheet feeding unit, and the insertion apparatus in the image forming system are provided with a sheet feeding apparatus for separating one of sheets stacked on a sheet stacking unit from the other sheets and feeding the sheet to convey the sheets to an image forming unit or the post-processing apparatus. An example of the sheet feeding apparatus is an air sheet feeding type for blowing air from side surfaces of sheets stacked on a sheet stacking unit to float the sheets and adsorbing the uppermost sheet onto a suction conveyance belt to convey the sheet, as discussed in U.S. Pat. No. 5,645,274.

FIG. 9 is a schematic view of an example of the sheet feeding apparatus of the air sheet feeding type.

The sheet feeding apparatus includes a tray 12 on which sheets P are stacked, a leading edge regulating plate 17 for regulating a leading edge position in a sheet feeding direction of the sheets P, and a trailing edge regulating plate 13 for regulating a trailing edge position of the sheets P. The sheet feeding apparatus further includes a side edge regulating plate 14 for regulating a position in a direction perpendicular to the sheet feeding direction of the sheets P (a sheet width direction). The regulating plates respectively position the front, rear, and right and left of the sheets P stacked on the tray 12. The sheet feeding apparatus further includes an air blowing unit for blowing air from a side of a sheet bundle stacked on the tray 12, and a suction conveyance unit arranged in its upper part for adsorbing and conveying the uppermost sheet.

The air blowing unit includes a blowing nozzle 33 for blowing air on the top of the sheet bundle stacked on the tray 12 from the side to float several top sheets P in the sheet bundle. The air blowing unit further includes a separation nozzle 34 for blowing air between the uppermost sheet floated by the air blown from the blowing nozzle 33 and the sheets P under the uppermost sheet to separate the uppermost sheet from the other sheets P.

A suction conveyance unit includes a suction conveyance belt 21 for adsorbing the sheet P and conveying the adsorbed sheet P rightward in FIG. 9, a suction duct 51 arranged inside the suction conveyance belt 21, and a suction fan 36 for making the pressure in the suction duct 51 negative. The suction conveyance belt 21 is provided with a lot of suction holes. Air is sucked in from the suction holes by the negative pressure in the suction duct 51 so that the uppermost sheet is adsorbed on an attraction surface of the suction conveyance belt 21. The suction duct 51 is provided with an adsorption completion detection sensor 19 for detecting that the sheet P has been adsorbed on the suction conveyance belt 21.

The position in the sheet feeding direction of the sheets P stacked on the tray 12 is regulated by the leading edge regulating plate 17 and the trailing edge regulating plate 13. Air blown in a direction D in FIG. 9 by the blowing nozzle 33 floats the several top sheets P in the sheet bundle, and air blown in a direction E in FIG. 9 separates one sheet P from the other sheets by the separation nozzle 34 so that the sheet P can be adsorbed on the suction conveyance belt 21. Furthermore, the suction fan 36 brings the inside of the suction duct 51 into a negative pressure condition so that the sheet P can be adsorbed on the suction conveyance belt 21. After the adsorption completion detection sensor 19 detects the adsorption of the sheet P on the suction conveyance belt 21, the adsorbed sheet P is conveyed rightward in FIG. 9 by rotating the suction conveyance belt 21.

In recent years, a need to produce a booklet has been increased. Tab-attached sheets may be used as a partition of the booklet. In a sheet feeding apparatus of an air sheet feeding type, the need to feed the tab-attached sheets has arisen.

In the sheet feeding apparatus, the setting direction on the tray 12 of the tab-attached sheets differs depending on an image formation position of an image forming apparatus and a processing position of a post-processing apparatus connected to the downstream side of the image forming apparatus. When the tab-attached sheets with their tab portions on the leading edge side are fed, the tab-attached sheets are set on the tray 12 with the tab portions on the downstream side in the sheet feeding direction. When the tab-attached sheets with their tab portions on the trailing edge side are fed, the tab-attached sheets are set on the tray 12 with the tab portions on the upstream side in the sheet feeding direction.

When the tab-attached sheets are set with the tab portions on the upstream side in the sheet feeding direction, if the length in a width direction (a direction perpendicular to the sheet feeding direction) of the trailing edge regulating plate 13 is small, the tab portions may not be regulated depending on the position, so that the tab-attached sheets are shifted backward. As proposed in Japanese Patent Application Laid-Open Gazette No. 2000-229732, this problem is solved by attaching a tab guide member that can abut on all tab portions of set tab-attached sheets, to a trailing edge regulating plate.

When the tab-attached sheets set with the tab portions on the downstream side in the sheet feeding direction are fed, however, the following problem occurs. FIG. 10 is a lower perspective view of the suction conveyance unit in a case where the tab-attached sheets S are thus set and the uppermost tab-attached sheet SA. FIG. 11 is an upper perspective view of the suction port 52 of the suction duct 51 and the tab-attached sheet S.

The suction port 52 is formed on a lower surface of the suction duct 51, and is opposed to the suction holes of the suction conveyance belt 21. When the pressure in the suction duct 51 becomes negative, air is sucked in from the suction holes of the suction conveyance belt 21 via the suction port 52. Thus, the uppermost tab-attached sheet SA is adsorbed onto the suction conveyance belt 21.

Generally, the tab portion of the tab-attached sheet S is formed with its one part projected, at its edge. Furthermore, a position formed along the edge of the tab-attached sheet S is shifted for each sheet. When the tab-attached sheet S is set with the tab portion on the downstream side in the sheet feeding direction, as illustrated in FIG. 10, if the uppermost tab-attached sheet SA is adsorbed, the suction port 52 of the suction duct 51 cannot be block with the uppermost tab-attached sheet SA. Therefore, a part of the suction port 52 is opposed to not only the uppermost tab-attached sheet SA but also the subsequent tab-attached sheet. When air is sucked in from the suction holes of the suction conveyance belt 21 with the pressure in the suction duct 51 made negative in this state, respective tab portions of tab-attached sheets SB, SC, SD, . . . under the uppermost tab-attached sheet SA are adsorbed, as illustrated in FIG. 11. When the sheets S under the uppermost tab-attached sheet SA are thus adsorbed, two or more of the sheets S are adsorbed on the suction conveyance belt 21 and conveyed. Therefore, double feeding (a phenomenon that sheets are fed in an overlapping state) occurs.

A portion 52A indicated by oblique hatching in FIG. 11 is a portion, of the suction port 52 of the suction duct 51, which cannot be block with the uppermost tab-attached sheet SA.

When the tab-attached sheets S are set with their tab portions on the downstream side in the sheet feeding direction, an area, which overlaps with the tab portion, of the suction port 52 of the suction duct 51 is block. As a result, the respective tab portions of the tab-attached sheets SB, SC, SD . . . under the uppermost tab-attached sheet SA are prevented from being adsorbed, and double feeding is avoided. If this configuration is adopted, however, a distance L between the leading edge regulating plate 17 and the suction port 52 of the suction duct 51 is lengthened. In this portion at the distance L, the tab-attached sheets S cannot be adsorbed. Therefore, a range in which the leading edge side of the sheets cannot be adsorbed, is widened. When sheets other than the tab-attached sheets S are fed, if the sheets are thin sheets having low rigidity, for example, their leading edges hang. When the suction conveyance belt 21 starts to convey the sheets, therefore, the sheets are caught by a guide or the like and jamming occurs. In other words, the suction port 52 of the suction duct 51 must be extended close to the leading edge regulating plate 17 as much as possible so that the leading edges of the sheets adsorbed on the adsorption conveyance belt 21 do not hang. When the suction port 52 is extended, however, double feeding of the tab-attached sheets S occurs, as described above.

SUMMARY OF THE INVENTION

The present invention is directed to a sheet feeding apparatus of an air sheet feeding type in which, even when tab-attached sheets with their tab portions on the downstream side in a sheet feeding direction are fed, double feeding and the jamming of the sheets does not occur.

According to an aspect of the present invention, a sheet feeding apparatus includes a sheet stacking unit on which sheets are stacked, a suction conveyance unit configure to convey an uppermost sheet stacked on the sheet stacking unit while adsorbing the uppermost sheet, a suction unit configured to adsorb the sheets onto the suction conveyance unit by a negative pressure, and an adsorption completion detection unit configured to detect that the adsorption of the sheets onto the suction conveyance unit is completed. In the sheet feeding apparatus, when the tab-attached sheets are stacked on the sheet stacking unit and fed such that their tab portions are on the downstream side in a sheet feeding direction, the suction unit starts to adsorb the sheet in response to a sheet feeding signal, and the suction conveyance unit starts to convey the sheet immediately after the adsorption completion detection unit detects the completion of the adsorption. When the sheets other than the tab-attached sheets are fed, the suction unit previously adsorbs the sheet onto the suction conveyance unit, and the suction conveyance unit starts to convey the sheet in response to the sheet feeding signal.

According to another aspect of the present invention, a sheet feeding apparatus includes a sheet stacking unit on which sheets are stacked, a suction conveyance unit configure to convey the uppermost sheet stacked on the sheet stacking unit while adsorbing the uppermost sheet, a suction unit configured to adsorb the sheets onto the suction conveyance unit by a negative pressure, and an adsorption completion detection unit configured to detect that the adsorption of the sheets onto the suction conveyance unit is completed. In the sheet feeding apparatus, the tab-attached sheets are stacked on the sheet stacking unit and fed such that their tab portions are on the downstream side in a sheet feeding direction, and after the adsorption completion detection unit detects the completion of the adsorption, the suction conveyance unit starts to convey the sheet, stops conveying the sheet after conveying the sheet by a predetermined amount, and resumes conveying the sheet further after conveying of the sheet is stopped for a predetermined period of time.

According to yet another aspect of the present invention, a sheet feeding apparatus includes a sheet stacking unit on which sheets are stacked, a suction conveyance unit configure to convey the uppermost sheet stacked on the sheet stacking unit while adsorbing the uppermost sheet, a suction unit configured to adsorb the sheets onto the suction conveyance unit by a negative pressure, and an adsorption completion detection unit configured to detect that the adsorption of the sheets on the suction conveyance unit is completed. In the sheet feeding apparatus, when the tab-attached sheets are stacked on the sheet stacking unit and fed such that their tab portions are on the downstream side in a sheet feeding direction, the suction unit stops adsorbing the sheet on the suction conveyance unit based on the detection by the adsorption completion detection unit, and the suction conveyance unit starts to convey the sheet after a predetermined period of time has elapsed.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings. It is to be noted that the relative arrangement of the components, the numerical expressions, and numerical values set forth in these embodiments are not intended to limit the scope of the present invention.

Figure 1:
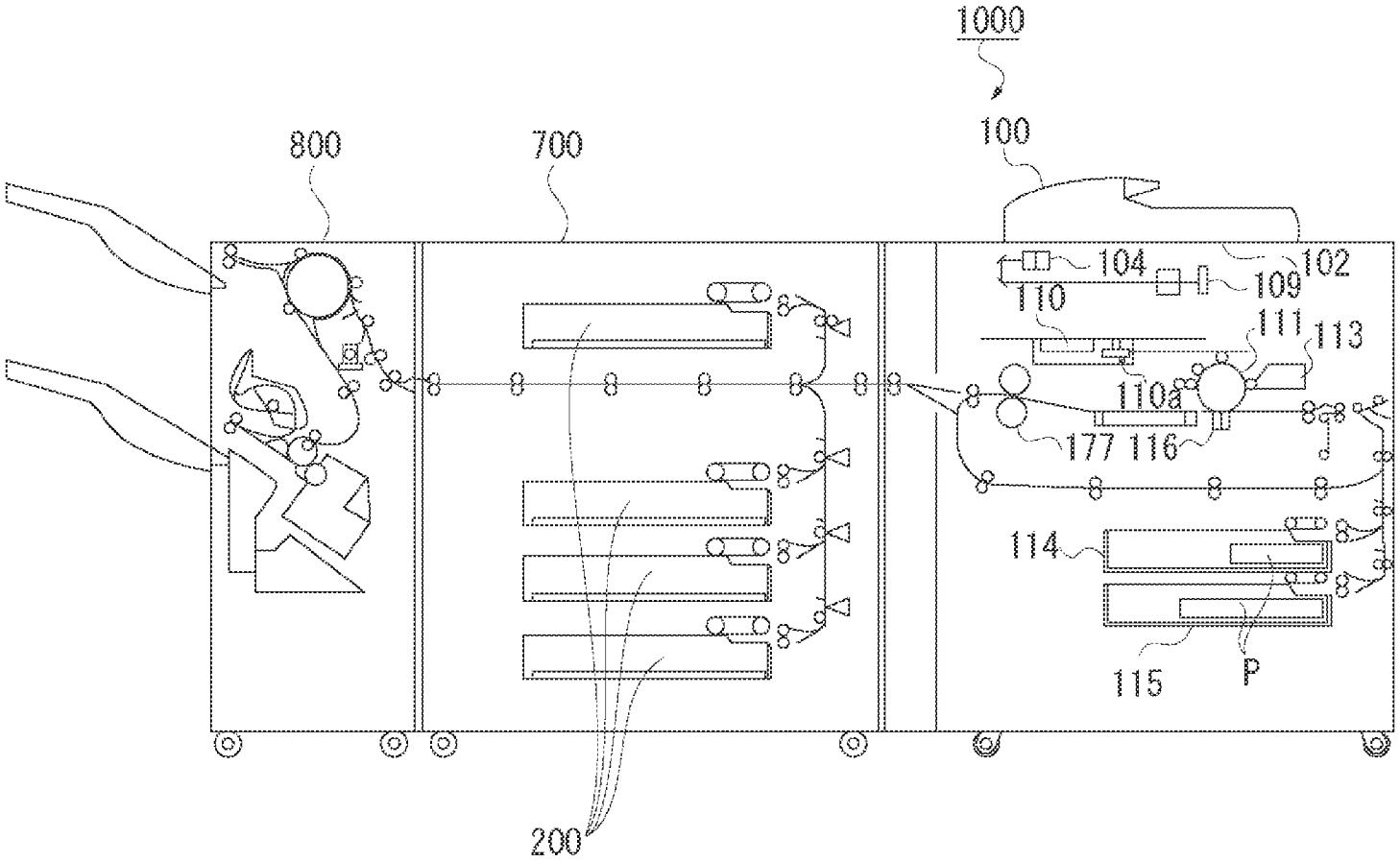
FIG. 1 is a cross-sectional view illustrating an example of an image forming apparatus according to an exemplary embodiment of the present invention.

FIG. 1 is a schematic sectional view of an image forming system according to a first exemplary embodiment of the present invention. An insertion apparatus 700 and a post-processing apparatus 800 serving as a unit for performing post-processing of sheets are successively connected, respectively, on the downstream side of an image forming apparatus 1000 and on the downstream side of the insertion apparatus 700, to constitute the image forming system.

First, the image forming apparatus 1000 will be described. A document feeding unit 100 automatically feeds a document to a reading position 102. An image reading unit including a scanner unit 104, an image sensor 109, and so on reads image information. The read image information is processed by a controller (not illustrated), and is fed to an exposure control unit 110. The exposure control unit 110 outputs a laser beam based on a processing result, to form an electrostatic latent image on a photosensitive drum 111.

On the other hand, sheets P such as paper sheets and overhead transparencies (OHT) are fed to the image forming unit from sheet feeding apparatuses 114 and 115 arranged below the image forming unit. In the image forming unit, a development unit 113 develops the electrostatic latent image on the photosensitive drum 111. A transfer unit 116 transfers a toner image on the photosensitive drum 111 obtained by the development on the sheets P. A fixing unit 177 fixes the transferred toner image on the sheets P. The sheets P are conveyed to the insertion apparatus 700 arranged on the downstream side of the image forming apparatus 1000.

The insertion apparatus 700 inserts another sheet into the first page, last page, or halfway page of a continuous sheet continuously conveyed after the image is formed thereon by the image forming apparatus 1000. The insertion apparatus 700 includes a plurality of sheet feeding apparatuses 200 of an air sheet feeding type. The configuration of the sheet feeding apparatus 200 will be described below. An insert sheet sent out at a desired timing from the sheet feeding apparatus 200 is fed between the sheets P on which the image has been formed without passing through the image forming apparatus 1000, and is conveyed to a sheet post-processing apparatus disposed on the downstream side thereof.

The post-processing apparatus 800 puts the sheets P on which the image has been formed and the insert sheet fed from the insertion apparatus 700 together and subjects the sheets P to stapling processing and folding processing, to form a booklet.

A first exemplary embodiment of the sheet feeding apparatus 200 according to the present invention will be described below.

Figure 2:
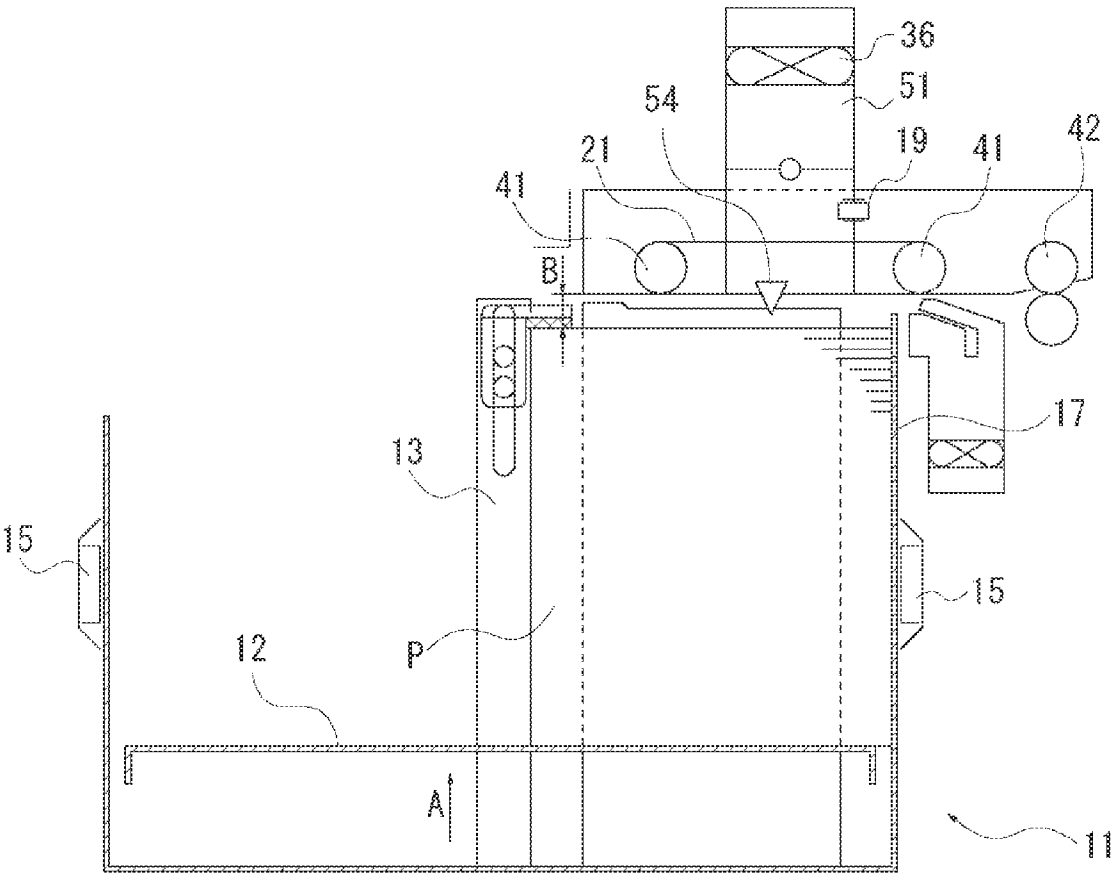
FIG. 2 is a cross-sectional view illustrating an example of a sheet feeding apparatus illustrated in FIG. 1.

In FIG. 2, a repository 11 serving as a sheet stacking unit includes a tray 12 on which a plurality of sheets P is stacked, and is controlled and elevated by a drive source such as a stepping motor or a direct current (DC) servo motor. The repository 11 includes a leading edge regulating plate 17 for regulating a position on the downstream side in a sheet feeding direction of the sheets P (on the leading edge side of the sheet), and a trailing edge regulating plate 13 for regulating a position on the upstream side in the sheet feeding direction of the sheets P (on the trailing edge side of the sheet). Furthermore, the repository 11 includes aside edge regulating plate 14 for regulating a position in a direction (a sheet width direction) at a right angle to a sheet conveyance direction of the sheets P. The trailing edge regulating plate 13 and the side edge regulating plate 14 can be slidably moved such that the positions thereof are optionally changed according to the size of the sheets P to be stored.

The repository 11 can be pulled out of the main body of the apparatus by a slide rail 15. The tray 12 falls to a predetermined position when the repository 11 is pulled out of the apparatus main body so that the sheets P can be replenished or replaced.

Furthermore, a sheet feeding mechanism of an air sheet feeding type for separating one of the sheets P from the other sheets and feeding the sheet P is arranged in an upper part of the repository 11 serving as a sheet stacking unit, as illustrated in FIG. 2. The sheet feeding mechanism of an air sheet feeding type includes a suction conveyance unit for adsorbing and conveying the sheet P, and an air blowing unit for floating several top sheets of the stored sheets P while separating one of the sheets P from the other sheets.

Figure 10:
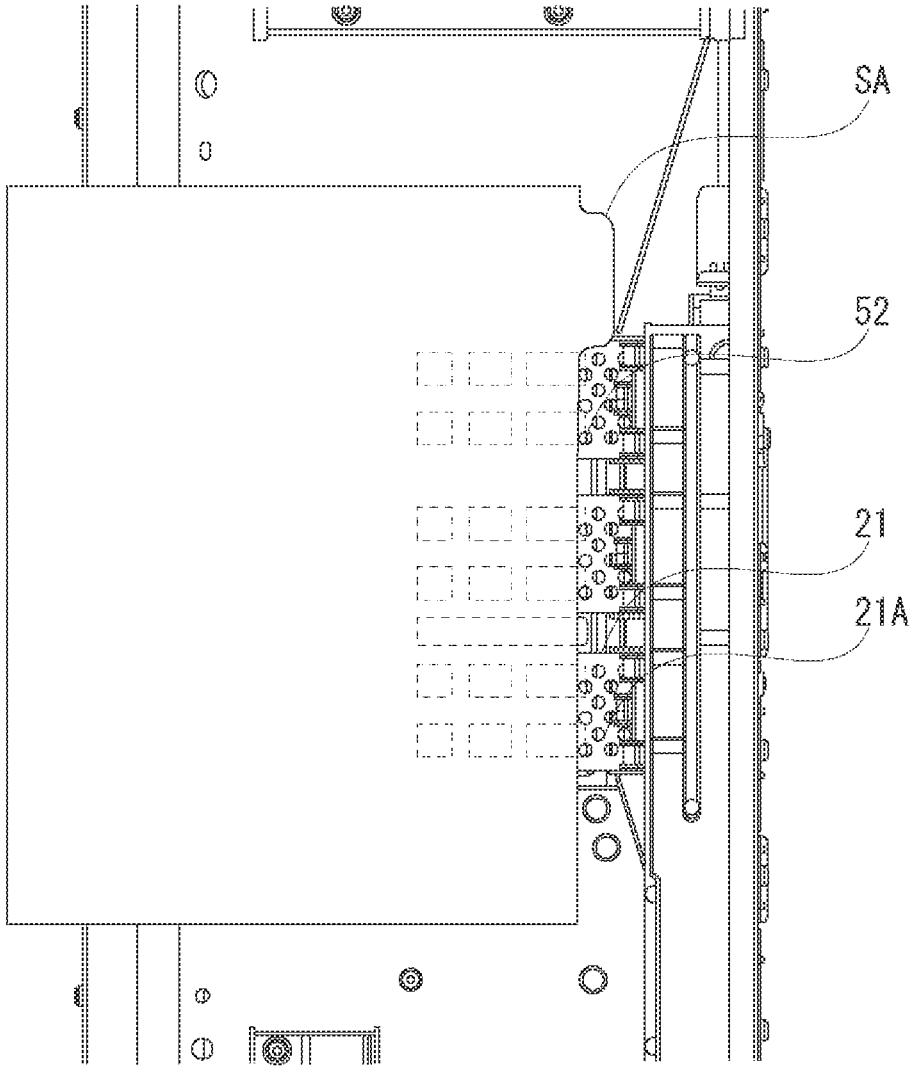
FIG. 10 is a lower perspective view illustrating a state where a tab-attached sheet is adsorbed in the conventional sheet feeding apparatus.
Figure 11:
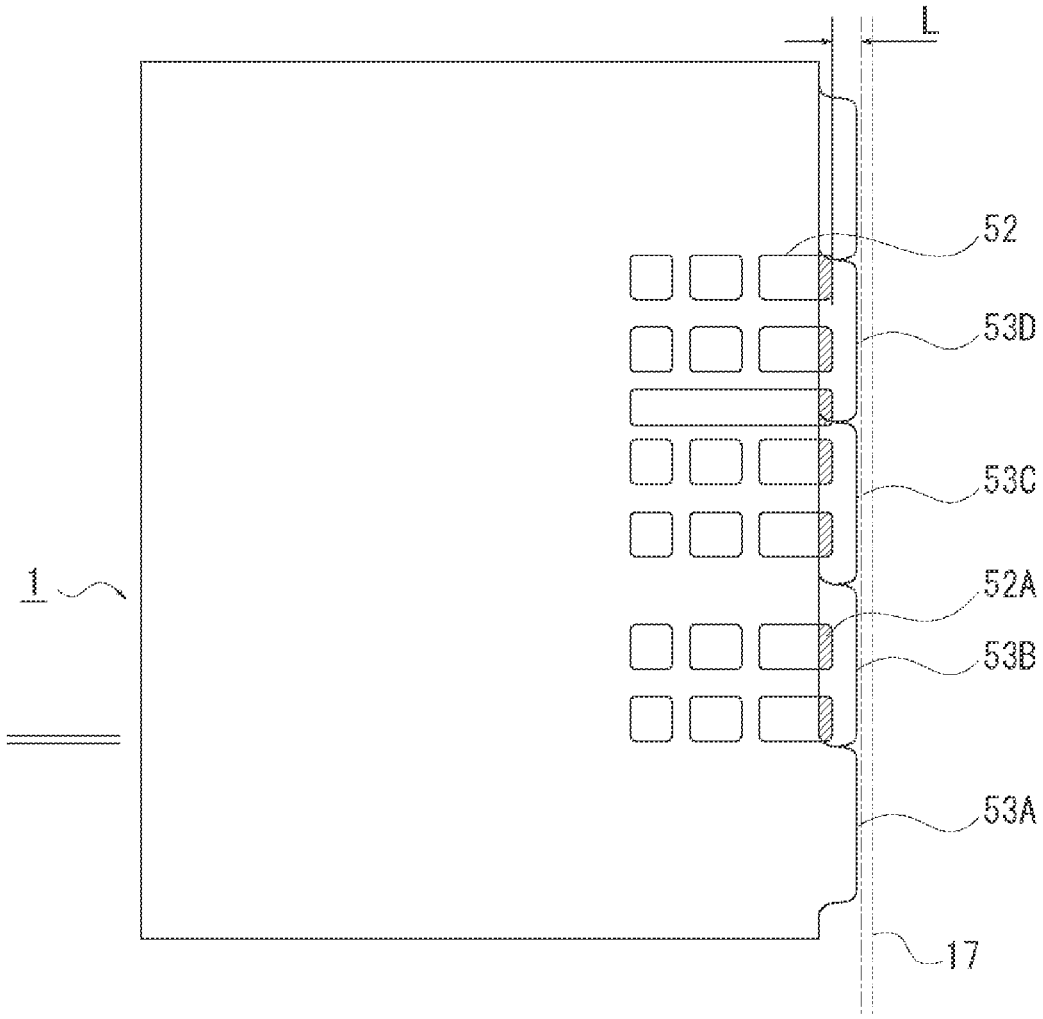
FIG. 11 is an upper perspective view illustrating a state where a tab-attached sheet is adsorbed in the conventional sheet feeding apparatus.

The suction conveyance unit includes a suction conveyance belt 21 stretched between belt drive rollers 41 for adsorbing the sheet P and conveying the adsorbed sheet P rightward in FIG. 2. The suction conveyance unit further includes a suction duct 51, a part of which is arranged inside the suction conveyance belt 21, for sucking in air via a suction hole 21A (illustrated in FIG. 10) formed in the suction conveyance belt 21. A suction fan 36 is arranged on the side opposite to the suction conveyance belt 21 in the suction duct 51. The suction fan 36 makes the pressure in the suction duct 51 negative to adsorb the sheet P on the suction conveyance belt 21.

An adsorption completion detection sensor 19 for detecting that the sheet P has been adsorbed on the suction conveyance belt 21 is arranged within the suction duct 51. The suction conveyance unit further includes a suction shutter 37 arranged between the suction fan 36 and the suction duct 51 for adsorbing the sheet P on the suction conveyance belt 21 or releasing the adsorption, and a solenoid 37SL (illustrated in FIG. 5) for operating the suction shutter 37. The suction fan 36 and the suction shutter 37 constitute a suction unit according to the present invention.

When the repository 11 is pulled out of the apparatus main body, to finish replenishing and replacing the sheets P, and is set again in the apparatus main body, the tray 12 rises in a direction A illustrated in FIG. 2, to stop at a position where a distance between the suction conveyance belt 21 and an upper surface of the uppermost sheet is B.

A sheet detection sensor 54 for detecting an upper surface of the sheet P is arranged in an upper part of the repository 11, to carry out rise stop control of the tray 12 in a case where the apparatus main body contains the repository 11, and elevation control of the tray 12 during a sheet feeding operation based on a detection signal from the sheet detection sensor 54. A control unit C, described below, determines whether the position of the uppermost sheet is best suited to feed the sheets P based on the result of an output from the sheet detection sensor 54. The elevation control of the tray 12 is performed during the sheet feeding operation according to the determination. During the sheet feeding operation, the sheets P are floated by blowing air from an air blowing unit, described below, so that an upper surface of the floated uppermost sheet is detected. The elevation control of the tray 12 positions the floated uppermost sheet within a region between an upper limit position and a lower limit position where the sheet can be fed.

Figure 3:
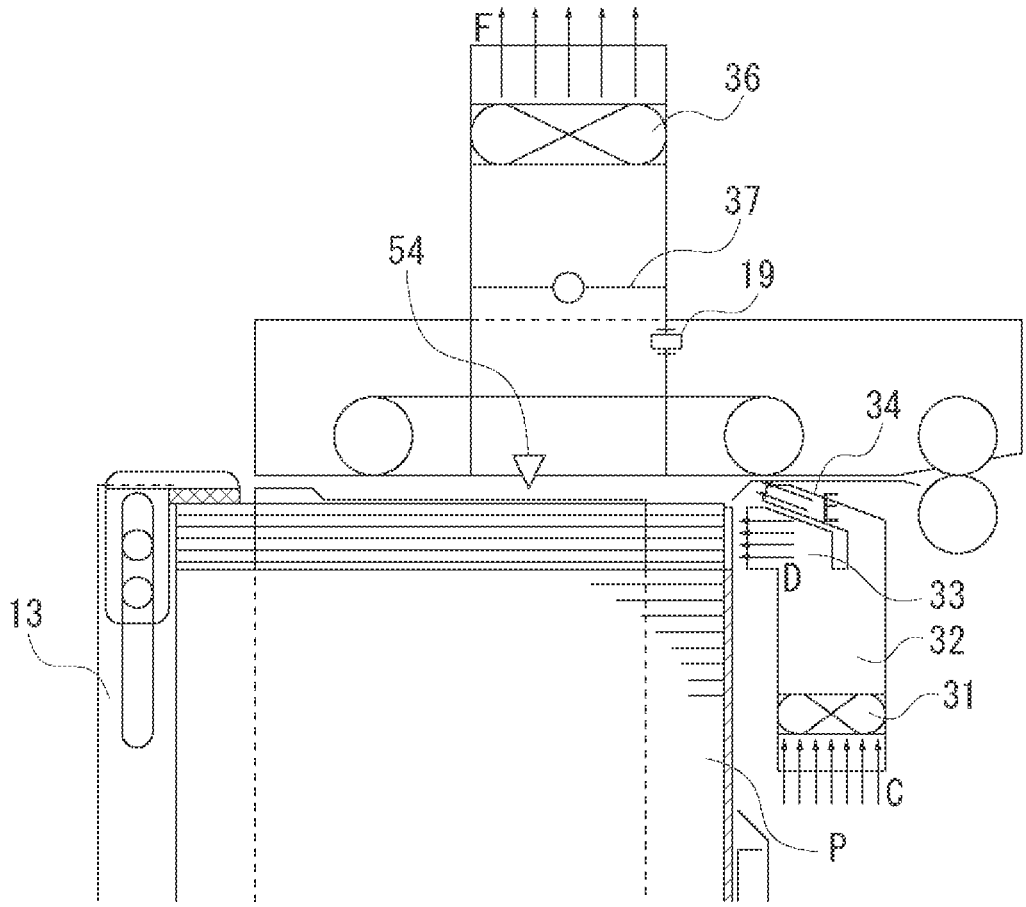
FIG. 3 illustrates an air blowing unit in the sheet feeding apparatus illustrated in FIG. 1.

The air blowing unit will be described with reference to FIG. 3. The air blowing unit includes a blowing nozzle 33 and a separation nozzle 34 for blowing air onto the top of the stored sheets P from the side. Air is fed to each of the nozzles 33 and 34 from a separation fan 31 via a separation duct 32. Air sucked in a direction C illustrated in FIG. 3 by the separation fan 31 is blown in a direction D by the blowing nozzle 33, to float the several top sheets of the sheets P supported on the tray 12 in the repository 11. Air blown out of the blowing fan 31 separates the uppermost sheet adsorbed on the suction conveyance belt 21 and the subsequent sheet.

Figure 5:
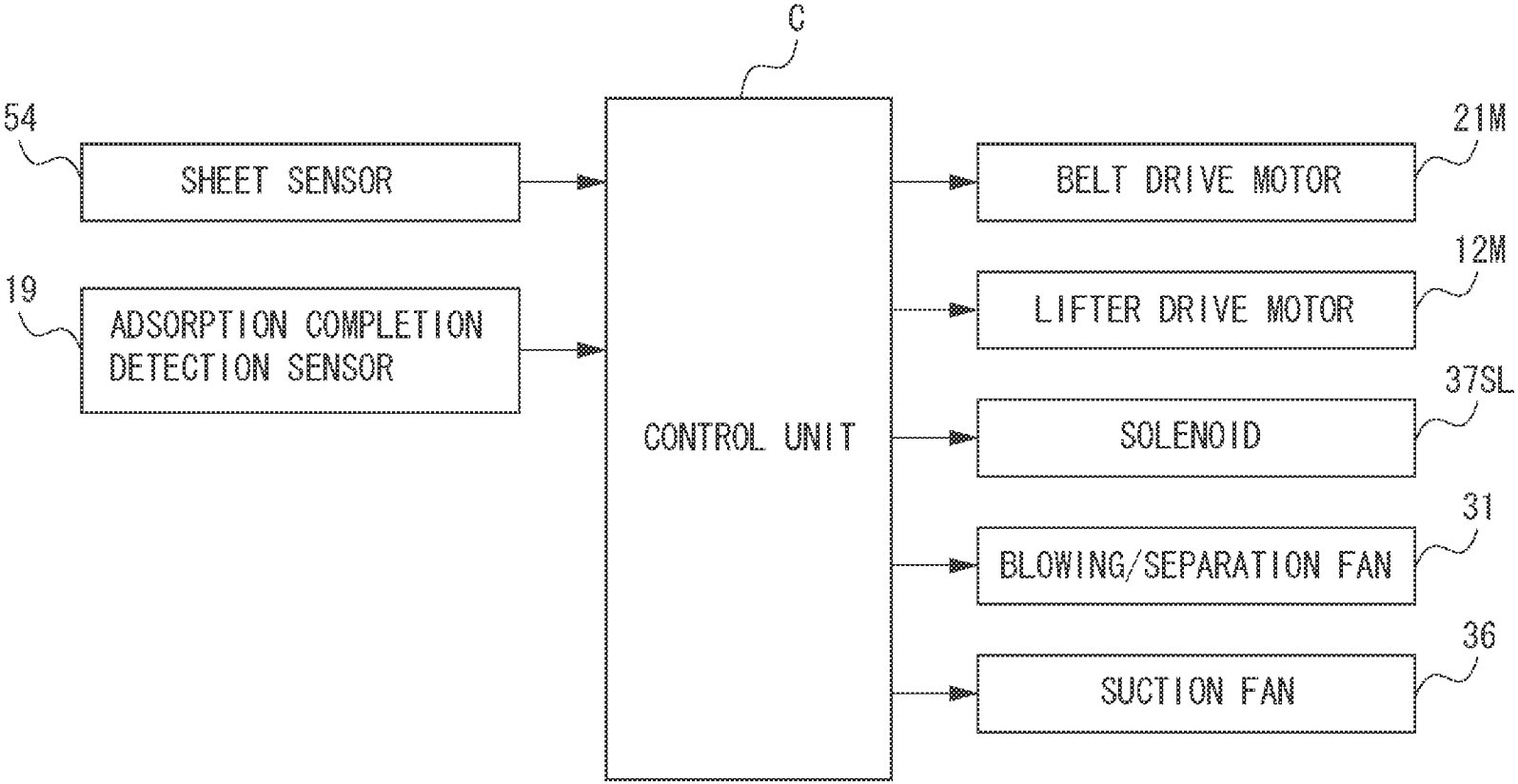
FIG. 5 is a block diagram of a control unit for controlling the sheet feeding apparatus illustrated in FIG. 1.

FIG. 5 is a block diagram for illustrating control of the sheet feeding apparatus 200 according to the present exemplary embodiment. The block diagram will be described with reference to FIG. 5.

Detection signals output from the sheet detection sensor 54 and the adsorption completion detection sensor 19 respectively are input to the control unit C. The control unit C controls a belt drive motor 21M, a tray drive motor 12M, a solenoid 37SL, a blowing/separation fan 31, and a suction fan 36, as needed, based on the detection signal of each of the sensors.

While the control unit C is arranged in the insertion apparatus 700 including the sheet feeding apparatus 200 in the present exemplary embodiment, the control unit C may also be provided in a control unit in an image forming apparatus 1000 or a post-processing apparatus 800 to which the insertion apparatus 700 is connected. If the image forming system has a control unit for controlling the entire system, the control unit C may be provided in the unit controlling the whole system.

The sheet feeding operation of the sheet feeding apparatus 200 according to the first exemplary embodiment will be then described with reference to FIG. 4.

When a sheet feeding preparation signal is input to the control unit C, the air blowing unit starts to blow air on the sheets P, to float the uppermost sheet within a defined region. At this time, the suction shutter 37 is closed, so that the inside of the suction duct 51 has not been brought into a negative pressure condition yet. Therefore, the uppermost sheet remains floated. The sheet feeding preparation signal is output before the sheet feeding signal in order to stabilize the floating of the sheets P when the sheet feeding signal is output, and is previously fed to the control unit C from the control unit in the apparatus main body before a predetermined period of time elapsed from the time when the sheet feeding signal is output.

When the sheet feeding signal is fed from the control unit C, the driving of the suction fan 36 is started, and the suction shutter 37 is rotated in a direction G illustrated in FIG. 6 by the solenoid 37SL, to generate a negative pressure within the suction duct 51. Suction power in a direction H illustrated in FIG. 4 is generated from a plurality of suction holes 21A provided in the suction conveyance belt 21 by the negative pressure within the suction duct 51. The uppermost one of the plurality of floated sheets P is adsorbed onto the suction conveyance belt 21. In the case, the separation nozzle 34 blows air to reliably separate the uppermost sheet from the other sheets, which inhibits the occurrence of double feeding.

Figure 4:
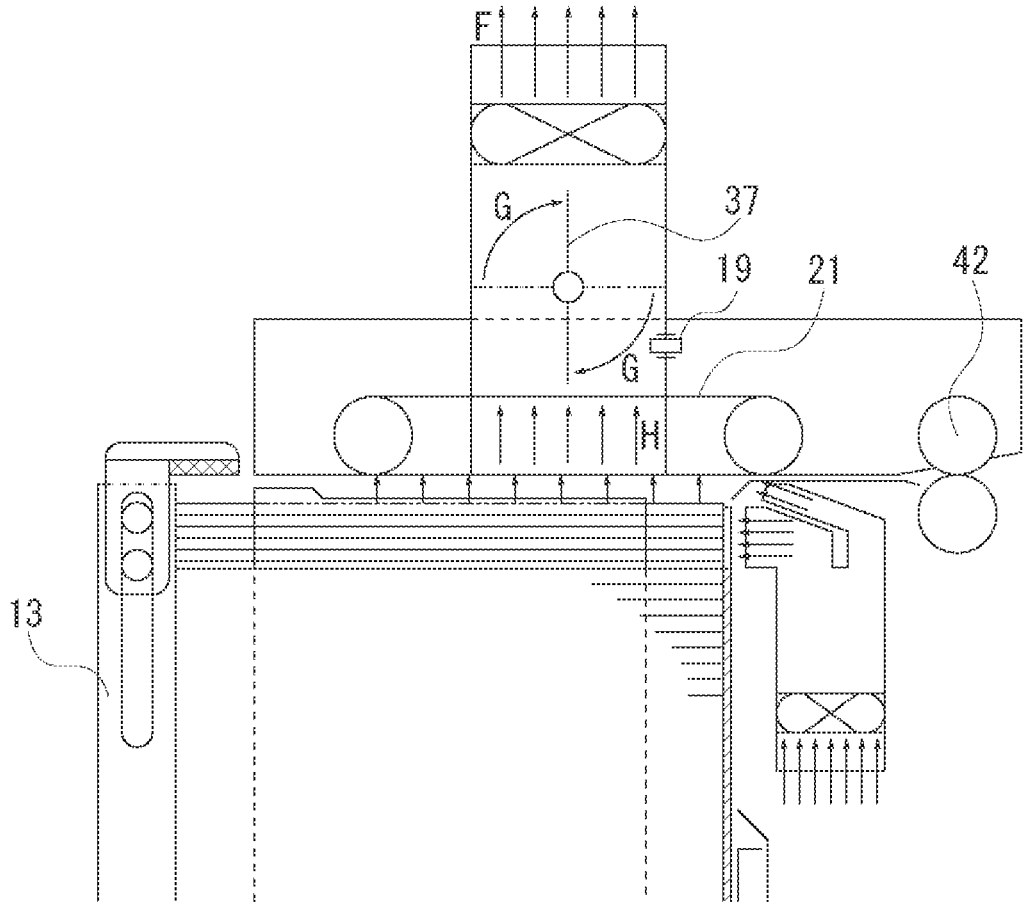
FIG. 4 illustrates an operation of the sheet feeding apparatus illustrated in FIG. 1.

Then, the belt drive roller 41 is rotated counterclockwise in FIG. 4, so that the sheet P adsorbed onto the suction conveyance belt 21 is conveyed rightward in FIG. 4, is further pulled out, is delivered into a roller pair 42, and is conveyed toward the image forming unit.

Figure 6A:
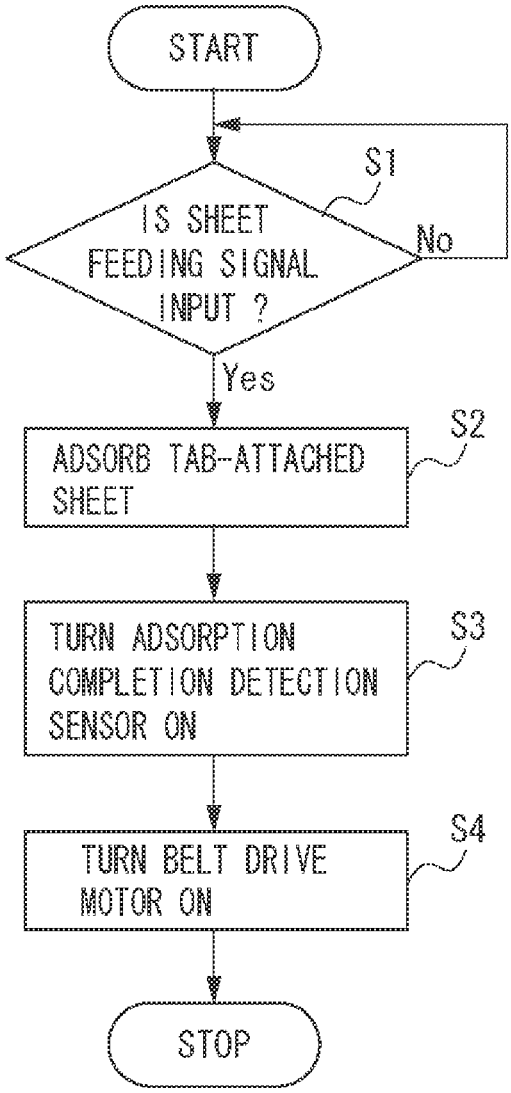
FIGS. 6A and 6B are flowcharts illustrating an operation of the sheet feeding apparatus according to the first exemplary embodiment of the present invention.

An operation for feeding tab-attached sheets with their tab portions on the downstream side in the sheet feeding direction, which characterizes the first exemplary embodiment of the present invention, will be described with reference to a flowchart of FIG. 6A.

When the sheet feeding preparation signal is input to the control unit C, as described above, the air blowing unit starts to blow air onto the tab-attached sheets, to float the uppermost tab-attached sheet within a defined region. At this time, the suction shutter 37 is closed, so that the inside of the suction duct 51 has not been brought into a negative pressure condition yet. Therefore, the uppermost tab-attached sheet remains floated.

In step S1, the control unit C determines whether the sheet feeding signal is input thereto from the control unit in the apparatus main body. If the sheet feeding signal is input (YES in step S1), then in step S2, the control unit C adsorbs the uppermost tab-attached sheet onto the suction conveyance belt 21 by opening the suction shutter 37 and sucking in air from the suction duct 51. In step S3, the control unit C turns on the adsorption completion detection sensor 19 after the tab-attached sheet is adsorbed onto the suction conveyance belt 21. In step S4, the control unit C turns on the belt drive motor 21M to rotate the suction conveyance belt 21 immediately after that, so that the uppermost tab-attached sheet that has been adsorbed onto the suction conveyance belt 21, is conveyed.

The reason why the suction conveyance belt 21 is rotated immediately after the adsorption completion detection sensor 19 is turned on in step S4, is that the tab portion of the tab-attached sheet floated under the uppermost tab-attached sheet may be attracted as time elapses because a portion on the downstream side of the suction duct 51 is not blocked in the sheet feeding direction of the suction port 52 after the uppermost tab-attached sheet is adsorbed onto the suction conveyance belt 21. The rotation of the suction conveyance belt 21 is started immediately after the adsorption completion detection sensor 19 is turned on so that the tab-attached sheet floated under the uppermost tab-attached sheet can start to be conveyed before adsorption onto the suction conveyance belt 21 occurs, to prevent double feeding.

"Immediately after the adsorption completion detection sensor 19 is turned on" means that the control unit C outputs a drive signal for rotating the suction conveyance belt 21 to the belt drive motor 21M to start the operation immediately after the detection signal of the adsorption completion detection sensor 19 is input to the control unit C. More specifically, a period of time elapsed since the adsorption completion detection sensor 19 detects the adsorption of the tab-attached sheet until the suction conveyance belt 21 starts to convey the tab-attached sheet is very short. Therefore, the uppermost tab-attached sheet is conveyed and can block the suction port 52 before the tab portion of the tab-attached sheet under the uppermost tab-attached sheet is adsorbed onto the suction conveyance belt 21.

Therefore, the tab portion of the tab-attached sheet under the uppermost tab-attached sheet is not adsorbed, which can prevent double feeding. Examples of the short period of time from the detection of the adsorption to the conveyance include a delay produced by a response time elapsed until the control unit C outputs a drive signal upon receipt of the detection signal from the detection sensor 19 or a response time elapsed until the belt drive motor 21M starts to rotate upon receipt of the drive signal. The delay is a short period of time of 10 to 20 msec. in the general apparatus.

Figure 6B:
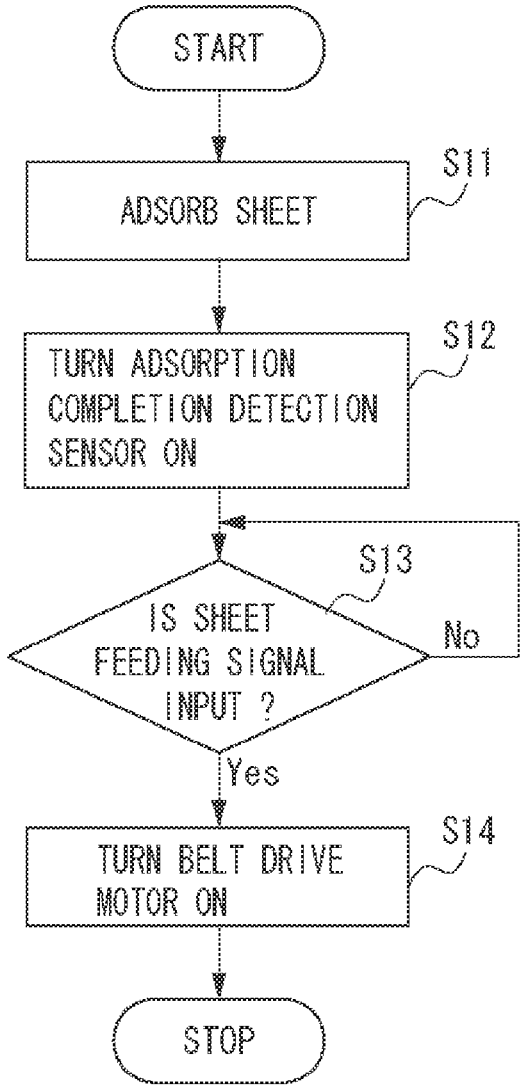

An operation for feeding sheets P other than the tab-attached sheets will be described below with reference to a flowchart of FIG. 6B.

When a sheet feeding preparation signal is first input, as in the control of the tab-attached sheets, the air blowing unit starts to blow air onto the sheets P, to float the uppermost sheet within a defined region. In step S11, the control unit C adsorbs the uppermost sheet onto the suction conveyance belt 21 by making the pressure in the suction duct 51 negative to suck in air after an elapse of a period of time during which the floating of the uppermost sheet is stabilized. In step S12, the control unit C turns on the adsorption completion detection sensor 19. In step S13, the control unit C determines whether the sheet feeding signal is input with the sheet P adsorbed on the suction conveyance belt 21. If the sheet feeding signal is input (YES in step S13), then in step S14, the control unit C turns on the belt drive motor 21M to rotate the suction conveyance belt 21, so that the sheet P adsorbed onto the suction conveyance belt 21 is conveyed.

The control unit C waits until the sheet feeding signal is input with the sheet P adsorbed on the sheet conveyance belt 21 in step S13 because the suction conveyance belt 21 can start to convey the sheet P immediately after the sheet feeding signal is input to realize high productivity. More specifically, the sheets P can be fed quickly and reliably by causing the suction conveyance belt 21 to wait with the uppermost sheet adsorbed on the suction conveyance belt 21 before the sheet feeding signal is input.

In controlling the feeding of the tab-attached sheets, the prevention of double feeding is given priority, although the productivity is slightly reduced because the adsorption onto the suction conveyance belt 21 is started after the sheet feeding signal is input. In controlling the feeding of the tab-attached sheets, the conveyance is started immediately after the suction conveyance belt 21 detects the tab-attached sheet. Therefore, the separation properties are slightly reduced. Since the tab-attached sheets are generally used for a partition of a booklet, however, relatively thick paper is used, which contributes to high rigidity and thus superior separation properties. Therefore, the defective separation hardly occurs.

As described above, in the sheet feeding apparatus of an air sheet feeding type, even when tab-attached sheets with their tab portions on the downstream side in the sheet feeding direction are fed, double feeding and jams of the sheets can be prevented.

Figure 7:
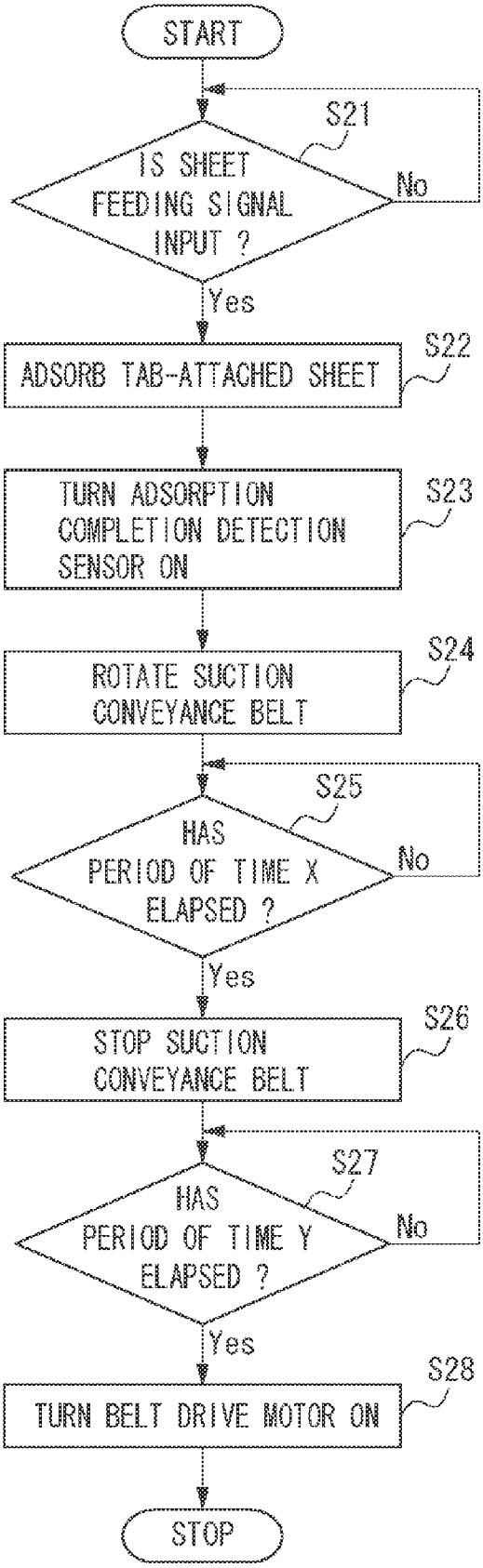
FIG. 7 is a flowchart illustrating an operation of a sheet feeding apparatus according to a second exemplary embodiment of the present invention.

Referring to a flowchart of FIG. 7, an operation for feeding tab-attached sheets with their tab portions on the downstream side in a sheet feeding direction according to a second exemplary embodiment will be described. The second exemplary embodiment is the same as the first exemplary embodiment except for conveyance control and hence, the similar description is not repeated. Only different portions for the conveyance control will be described in detail.

When a sheet feeding preparation signal is input to a control unit C, an air blowing unit starts to blow air onto tab-attached sheets, to float the uppermost tab-attached sheet within a defined region. At this time, a suction shutter 37 is closed, so that the inside of a suction duct 51 has not been brought into a negative pressure condition yet. Therefore, the uppermost tab-attached sheet remains floated.

In step S21, the control unit C determines whether a sheet feeding signal is input thereto from a control unit in an apparatus main body. If the sheet feeding signal is input (YES in step S21), then in step S22, the control unit C adsorbs the uppermost tab-attached sheet onto a suction conveyance belt 21 by opening the suction shutter 37 and sucking in air from the suction duct 51. In step S23, the control unit C turns on an adsorption completion detection sensor 19 after the uppermost tab-attached sheet is adsorbed onto the suction conveyance belt 21. In step S24, the control unit C rotates the suction conveyance belt 21 immediately after that, to convey the uppermost tab-attached sheet adsorbed onto the suction conveyance belt 21.

The foregoing control is the same as that in the first exemplary embodiment. A state that "the suction conveyance belt 21 is rotated immediately after the adsorption completion detection sensor 19 is turned on" is the same as that in the first exemplary embodiment.

The uppermost tab-attached sheet is conveyed by a predetermined amount to a position where the tab portion of the tab-attached sheet under the uppermost tab-attached sheet is not adsorbed, i.e., a position where the suction port 52 of the suction duct 51 is block. The conveyance amount of the uppermost tab-attached sheet at this time, at minimum, corresponds to a region opposing the suction port 52 of the suction duct 51, in the tab-attached sheet other than the uppermost tab-attached sheet (the length in the sheet feeding direction). The conveyance amount is set to approximately 3 mm to a maximum of approximately 12 mm that is the tab width of the tab-attached sheets generally distributed in the market, although it differs depending on the apparatus.

Determination whether the tab-attached sheet is conveyed by the set conveyance amount is made by dividing the conveyance amount by the sheet conveyance speed of the suction conveyance belt 21 to calculate a period of time X and it is determined whether the calculated period of time X has elapsed. In step S25, the control unit C determines whether the calculated period of time X has elapsed. If the period of time X has elapsed (YES in step S25), then in step S26, the control unit C stops the suction conveyance belt 21. A state that the uppermost tab-attached sheet moves and is stopped is continued for a predetermined period of time Y (e.g., one second) so that the adsorption of the uppermost tab-attached sheet can be reduced. In step 27, the control unit C determines whether the predetermined period of time Y has elapsed. If the period of time Y has elapsed (YES in step S27), then in step S28, the control unit C turns on the belt drive motor 21M to rotate the suction conveyance belt 21, to resume conveying the tab-attached sheet.

An operation for feeding sheets other than the tab-attached sheets is the same as the sheet feeding operation in the first exemplary embodiment (see FIG. 6B) and hence, the description thereof is not repeated.

Figure 8:
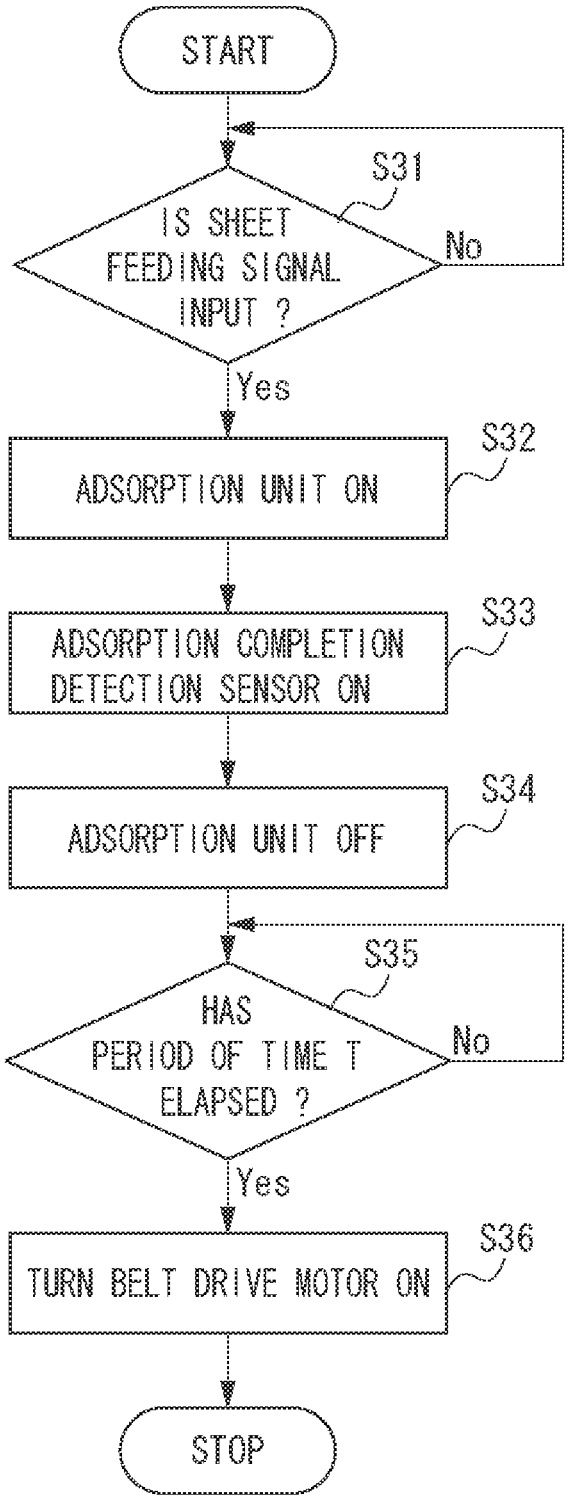
FIG. 8 is a flowchart illustrating an operation of a sheet feeding apparatus according to a third exemplary embodiment of the present invention.
Figure 9:
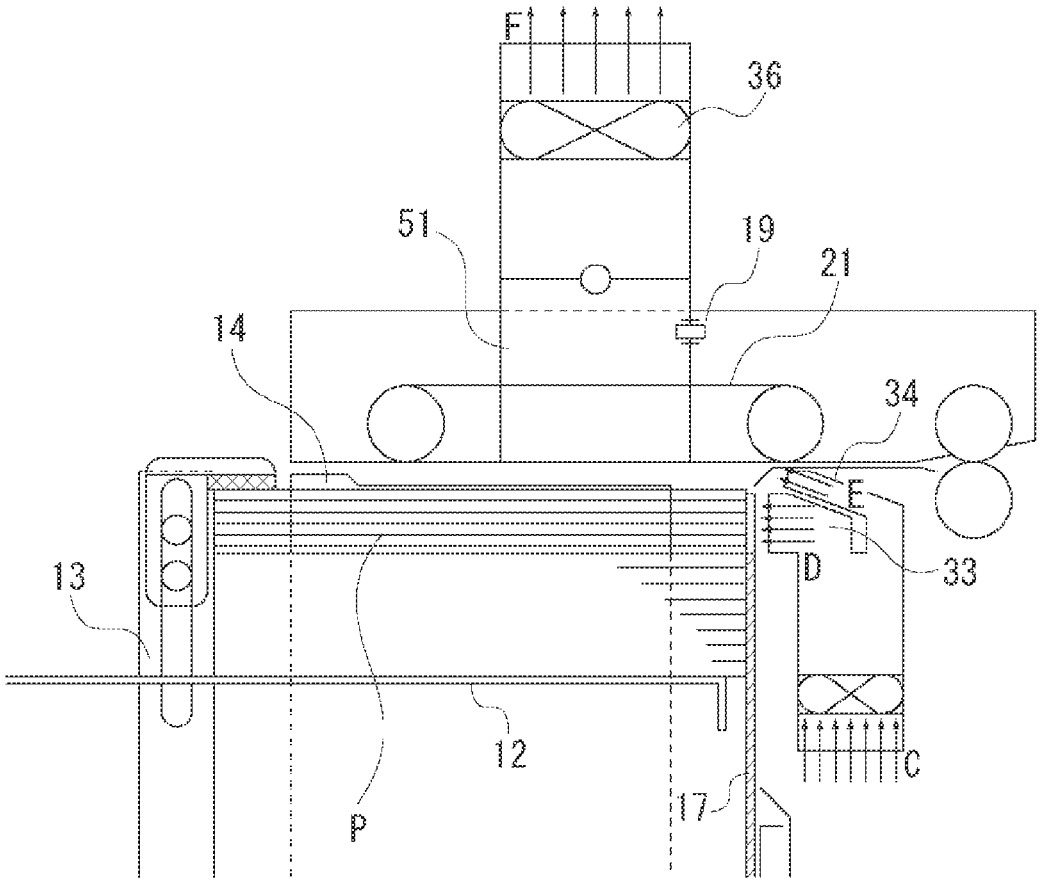
FIG. 9 illustrates the configuration of a conventional sheet feeding apparatus.

Referring to a flowchart of FIG. 8, an operation for feeding tab-attached sheets with their tab portions on the downstream side in a sheet feeding direction according to a third exemplary embodiment of the present invention will be described. The third exemplary embodiment is the same as the first exemplary embodiment except for conveyance control and hence, the similar description is not repeated. Therefore, only different portions for the conveyance control will be described in detail.

When a sheet feeding preparation signal is input to a control unit C, an air blowing unit starts to blow air onto the tab-attached sheets, to float the uppermost tab-attached sheet within a defined region. At this time, a suction shutter 37 is closed, so that the inside of a suction duct 51 has not been brought into a negative pressure condition yet. Therefore, the uppermost tab-attached sheet remains floated.

In step S31, a control unit C determines whether a sheet feeding signal is input thereto. If the sheet feeding signal is input (YES in step S31), then in step S32, the control unit C adsorbs the uppermost tab-attached sheet on a suction conveyance belt 21 by opening the suction shutter 37 and sucking in air from the suction duct 51 in a negative pressure condition via a suction hole 21A of the suction conveyance belt 21. In step S33, the control unit C turns on an adsorption completion detection sensor 19 after the uppermost tab-attached sheet is adsorbed. In step S34, the control unit C releases the adsorption onto the suction conveyance belt 21 when the suction shutter 37 closes the suction duct 51 immediately after that.

At this time, a negative pressure in the suction duct 51 is gradually reduced because there is a gap at the front (a portion opposed to the tab portion) of a suction port 52 of the suction duct 51. However, the uppermost tab-attached sheet remains adsorbed onto the suction conveyance belt 21 for a while. In step S35, the control unit C turns on a belt drive motor 21M after an elapse of a predetermined period of time T (e.g., approximately 40 msec) since the suction shutter 37 was closed.

At this time, even after the uppermost tab-attached sheet is adsorbed onto the suction conveyance belt 21, a portion on the downstream side in a sheet feeding direction of the suction port 52 of the suction duct 51 is not block, so that the tab portion of the tab-attached sheet under the uppermost tab-attached sheet may be adsorbed. Therefore, even if the tab portion of the tab-attached sheet other than the uppermost tab-attached sheet is adsorbed, when a predetermined period of time has elapsed since the suction shutter 37 was closed, the negative pressure in the suction duct 51 is also reduced, so that the adsorptivity of the sheet is also reduced. The adsorption is released by the self-weight of the sheet.

In step S36, the control unit C drives the belt drive motor 21M to rotate the suction conveyance belt 21, to convey the uppermost tab-attached sheet after the period of time T has elapsed. Thus, only the uppermost tab-attached sheet can be conveyed to prevent double feeding.

Adsorptivity required by the suction conveyance belt 21 differs depending on the sheet type such as the grammage, the size, the surface property, and the air permeability of sheets and sheet feeding conditions such as temperature and humidity. For example, the greater the grammage is, or the greater the size is, the more easily the sheet free-falls by the self-weight. Thus, the predetermined period of time T can be set short. The higher the temperature and humidity, the greater the amount of moisture in the sheet, and the heavier the weight. Therefore, the predetermined period of time T can be set short. In order to increase productivity (the number of sheets fed per unit time), therefore, the predetermined period of time T required to reduce the adsorptivity of the tab-attached sheet other than the uppermost tab-attached sheet can be changed, as needed, depending on the sheet type and the sheet feeding conditions.

In the above-mentioned control in each of the first to third exemplary embodiments of the present invention, even when in the sheet feeding apparatus in the insertion apparatus 700, the tab-attached sheets with their tab portions on the downstream side in the sheet feeding direction are fed, double feeding and jams of the sheets can be prevented from occurring. As a result, a dedicated mechanism for feeding the tab-attached sheets does not need to be added, which can suppress the rise in cost. The suction port 52 of the suction duct 51 can be extended close to the leading edge regulating plate 17. When the sheets other than the tab-attached sheets are fed, therefore, the sheet can be adsorbed close to its edge, which can prevent the sheets from jamming due to hanging at their leading edges. Particularly, this is effective for sheets having low rigidity because such sheets easily hang.

In each of the exemplary embodiments, a tab guide member that can abut on all tab portions of set tab-attached sheets, which is described in "Description of Related Art", is used as a trailing edge regulating plate, so that tab-attached sheets can be fed even if their tab portions are on the downstream side in a sheet feeding direction or in either direction on the downstream side. In a sheet feeding apparatus in which tab-attached sheets can be set only in one direction, therefore, a reversing mechanism must be provided on the downstream side, as needed. However, the reversing mechanism does not need to be used in the present exemplary embodiment, which can suppress the rise in cost.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. A sheet feeding apparatus comprising:

a sheet stacking unit on which sheets are stacked;

a suction conveyance unit configure to convey an uppermost sheet stacked on the sheet stacking unit while adsorbing the uppermost sheet;

a suction unit configured to adsorb the sheets onto the suction conveyance unit by a negative pressure;

an adsorption completion detection unit configured to detect that the adsorption of the sheets onto the suction conveyance unit is completed;

a control unit configured to control the suction conveyance unit and the suction unit; and an input unit configured to input to the control unit information that tab-attached sheets or sheets other than the tab-attached sheets are stacked on the sheet stacking unit, wherein the control unit controls the suction conveyance unit and the suction unit so that when the tab-attached sheets are stacked on the sheet stacking unit and fed such that their tab portions are on the downstream side in a sheet feeding direction, after the adsorption completion detection unit detects the completion of the adsorption, the suction conveyance unit starts to convey the sheet, stops conveying the sheet after conveying the sheet by a predetermined amount, and then resumes conveying the sheet further after conveying of the sheet is stopped for a predetermined period of time.

2. The sheet feeding apparatus according to claim 1, wherein the predetermined amount by which the suction conveyance unit conveys the sheet after the adsorption completion detection unit detects the completion of the adsorption, is set to different values depending on the shape of the tab portions.

3. A sheet feeding apparatus comprising:

a sheet stacking unit on which sheets are stacked;

a suction conveyance unit configure to convey the uppermost sheet stacked on the sheet stacking unit while adsorbing the uppermost sheet;

a suction unit configured to adsorb the sheets onto the suction conveyance unit by a negative pressure;

an adsorption completion detection unit configured to detect that the adsorption of the sheets onto the suction conveyance unit is completed;

a control unit configured to control the suction conveyance unit and the suction unit; and an input unit configured to input to the control unit information that tab-attached sheets or sheets other than the tab-attached sheets are stacked on the sheet stacking unit, wherein the control unit controls the suction conveyance unit and the suction unit so that when the tab-attached sheets are stacked on the sheet stacking unit and fed such that their tab portions are on the downstream side in a sheet feeding direction, the suction unit stops adsorbing the sheet onto the suction conveyance unit based on the detection by the adsorption completion detection unit, and the suction conveyance unit starts to convey the sheet after a predetermined period of time has elapsed.

4. The sheet feeding apparatus according to claim 3, wherein the predetermined period of time elapsed from when the suction unit stops adsorbing the sheet onto the suction conveyance unit until the suction conveyance unit starts to convey the sheet is set to different values depending on the sheet type.

5. An image forming apparatus comprising a sheet feeding apparatus configured to feed sheets, and an image forming unit configured to form an image on the sheets, wherein the sheet feeding apparatus comprises a sheet stacking unit on which sheets are stacked, a suction conveyance unit configured to convey an uppermost sheet stacked on the sheet stacking unit while adsorbing the uppermost sheet, a suction unit configured to adsorb the sheets onto the suction conveyance unit by a negative pressure, an adsorption completion detection unit configured to detect that the adsorption of the sheets onto the suction conveyance unit is completed;

a control unit configured to control the suction conveyance unit and the suction unit; and an input unit configured to input to the control unit information that tab-attached sheets or sheets other than the tab-attached sheets are stacked on the sheet stacking unit, wherein the control unit controls the suction conveyance unit and the suction unit so that when the tab-attached sheets are stacked on the sheet stacking unit and fed such that their tab portions are on the downstream side in a sheet feeding direction, after the adsorption completion detection unit detects the completion of the adsorption, the suction conveyance unit starts to convey the sheet, stops conveying the sheet after conveying the sheet by a predetermined amount, and then resumes conveying the sheet further after conveying of the sheet is stopped for a predetermined period of time.

6. The image forming apparatus according to claim 5, wherein the predetermined amount by which the suction conveyance unit conveys the sheet after the adsorption completion detection unit detects the completion of the adsorption, is set to different values depending on the shape of the tab portions.

7. An image forming apparatus comprising a sheet feeding apparatus configured to feed sheets, and an image forming unit configured to form an image on the sheets, wherein the sheet feeding apparatus comprises a sheet stacking unit on which sheets are stacked, a suction conveyance unit configured to convey an uppermost sheet stacked on the sheet stacking unit while adsorbing the uppermost sheet, a suction unit configured to adsorb the sheets onto the suction conveyance unit by a negative pressure, an adsorption completion detection unit configured to detect that the adsorption of the sheets onto the suction conveyance unit is completed;

a control unit configured to control the suction conveyance unit and the suction unit; and an input unit configured to input to the control unit information that tab-attached sheets or sheets other than the tab-attached sheets are stacked on the sheet stacking unit, wherein the control unit controls the suction conveyance unit and the suction unit so that when the tab-attached sheets are stacked on the sheet stacking unit and fed such that their tab portions are on the downstream side in a sheet feeding direction, the suction unit stops adsorbing the sheet onto the suction conveyance unit based on the detection by the adsorption completion detection unit, and the suction conveyance unit starts to convey the sheet after a predetermined period of time has elapsed.

8. The image forming apparatus according to claim 7, wherein the predetermined period of time elapsed from when the suction unit stops adsorbing of the sheet onto the suction conveyance unit until the suction conveyance unit starts to convey the sheet is set to different values depending on the sheet type, wherein when the tab-attached sheets are stacked on the sheet stacking unit and fed such that their tab portions are on the downstream side in a sheet feeding direction, the suction unit is opened to start to adsorb the sheet in response to a sheet feeding signal, and a suction conveyance unit is rotated to start to convey the sheet immediately after the suction completion detection unit detects the completion of the adsorption, and when the sheets other than the tab-attached sheets are fed, the suction unit is previously opened to adsorb the sheet onto the suction conveyance unit, and the suction conveyance unit is rotated to convey the sheet in response to the sheet feeding signal.

* * * * *